United States Patent [19]

Wang et al.

[11] 4,158,623

[45] Jun. 19, 1979

[54] PROCESS FOR FROTH FLOTATION OF PHOSPHATE ORES

[75] Inventors: Samuel S. Wang, Cheshire; Ernie F. Huliganga, Milford, both of Conn.

[73] Assignee: American Cyanamid Company, Stamford, Conn.

[21] Appl. No.: 863,029

[22] Filed: Dec. 21, 1977

[51] Int. Cl.[2] ..... B03D 1/02

[52] U.S. Cl. ..... 209/166

[58] Field of Search ..... 209/166, 167; 252/61

[56] References Cited

U.S. PATENT DOCUMENTS

| | | | |
|---|---|---|---|
| 2,373,305 | 4/1945 | Gieseke | 209/166 |
| 3,098,817 | 7/1963 | Baarson | 209/166 |
| 3,102,856 | 9/1963 | Chase | 209/166 |
| 3,779,380 | 12/1973 | Bishop | 209/166 |
| 3,915,391 | 12/1975 | Melcade | 209/166 |

FOREIGN PATENT DOCUMENTS

| | | | |
|---|---|---|---|
| 461394 | 11/1949 | Canada | 209/166 |
| 2312297 | 12/1976 | France | 209/166 |
| 2338324 | 12/1977 | France | 209/166 |

*Primary Examiner*—Robert Halper
*Attorney, Agent, or Firm*—William J. Van Loo

[57] ABSTRACT

Conditioning of an aqueous slurry of a phosphate ore with a combination of a fatty acid and a dialkylsulfosuccinic acid or salt thereof provides improved beneficiation upon froth flotation of the conditioned ore.

10 Claims, No Drawings

PROCESS FOR FROTH FLOTATION OF PHOSPHATE ORES

CROSS-REFERENCE TO RELATED APPLICATION

This application is related to application Ser. No. 862,993 filed on Dec. 21, 1977 and now abandoned. The instant application relates to the use of a combination of a fatty acid and a dialkylsulfosuccinate or salt thereof in the froth flotation of non-sulfide ores and the related application relates to the composition.

This invention relates to a process for beneficiating non-sulfide ores by froth flotation. More particularly, this invention relates to such a process wherein the collector employed is a combination of a fatty acid and a dialkyl sulfosuccinic acid or salt thereof.

Froth flotation is the principal means by which phosphate, barite, fluorite, hematite, taconite, magnetite and a host of other non-sulfide ores are concentrated. Its chief advantage lies in the fact that it is a relatively efficient process operating at substantially lower costs than many other processes.

Flotation is a process for separating finely ground valuable minerals from their associated gauge, or waste, or for separating valuable components one from another. In froth flotation, frothing occurs by introducing oil into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired mineral. The agents chosen must be capable of selectively coating the desired material in spite of the presence of many other mineral species. Current theory states that the flotation separation of one mineral species from another depends upon the relative wettability of surfaces. Typically, the surface free energy is purportedly lowered by the adsorption of heteropolar surface-active agents. The hydrophobic coating thus provided acts in this explanation as a bridge so that the particle may be attached to an air bubble. The practice of this invention, however, is not limited by this or other theories.

Typical of non-sulfide ores is phosphate rock. Typically, phosphate ore containing about 15–35% BPL [bone phosphate of lime $Ca_3(PO_4)_2$] is concentrated in very large tonnages from the Florida pebble phosphate deposits. The ore slurry from strip mining is sized, or classified, at about 1 millimeter and the coarser fraction, after scrubbing to break up mud balls, is a finished product. The minus 1 mm. fraction is further sized at 35 and 200 mesh. The minus 200 mesh slime is discarded. From the sizing operation, the +35 mesh material in thick slurry is treated with fatty acid, full oil, and caustic, ammonia, or other alkaline material and the rusulting agglomerates are separated on shaking tables, spirals, or spray belts. The 35×200 mesh fraction is conditioned with the same type of reagents and floated by conventional froth flotation routes. Not all the silica gaugue is rejected by the fatty acid flotation, so the concentrate is blunged with acid to remove collector coatings, deslimed, wash free of reagents, and subjected to an amine flotation with fuel oil at pH 7–8. This latter flotation, sometimes called "cleaning", removes additional silica and raises the final concentrate grade to 75–80% BPL.

Although the procedure described above is effective in the recovery of mineral values from non-sulfide ores, it is dependent upon collectors that are in critical short supply. The fatty acids which are derived from vegetable and animal oils, are constantly being diverted to nutritional and other uses, thus making their availability for mining uses continually less. There exists, therefore, the need for effective extenders which can reduce the requirements for reagents in short supply while providing desirable levels of recovery and grade of the mineral values of interest. In view of the vast amounts of non-sulfide ores processed using reagents which are constantly being diverted to nutritional and other uses and, thus, becoming continually shorter in supply, the development of an effective exteuder could free large quantities of the critical reagents for other uses while enabling the required recoveries of non-sulfide ores to be effected.

In accordance with the present invention, there is provided a process for beneficiating phosphate ores which comprises sizing the ore to provide mineral values of flotation size, slurrying the sized ore in aqueous medium, conditioning the slurried ore with an effective amount of a combination collector, and thereafter recovering the desired mineral values by froth flotation, said collector combination comprising from about 1 to about 99 weight percent of a fatty acid derived from a vegetable or animal oil and, correspondingly, from about 99 to about 1 weight percent of a dialkyl sulfosuccinic acid of the general structure.

$$\begin{array}{l} \quad\quad\quad CH_2COOR \\ \quad\quad\quad\quad | \\ XO_3S-CHCOOR' \end{array}$$

wherein R and R′ are individually alkyl radicals to about 4 to 18 carbon atoms and X is hydrogen or an alklai metal or ammonium ion.

The process of the present invention by its use of a collector combination involving a dialkylsulfosuccinic acid or salt thereof as exteuder for the fatty acid not only reduces the amount of fatty acid required but also greatly reduces the total dosage of collector necessary to achieve the desired recovery and grade values. This beneficial result is surprising and entirely unexpected in view of the small amount of dialkyl sulfosuccinic acid or salt thereof necessary. In preferred instances, for example, use of a 95:5 weight ratio of fatty acid:dialkyl sulfosuccinic acid can reduce the fatty acid requirements to one-half the conventional requirement while still providing high recovery and grade.

In carrying out the process of the present invention, a phosphate mineral is selected for treatment. The selected mineral is sized, or classified (i.e., by screening), to provide particles of flotation size according to conventional procedures. Generally, the flotation size will encompass from about 35×150 mesh size.

After the selected mineral has been sized as indicated, it is slurried in aqueous medium and conditioned with the collector combination in effective amounts in accordance with conventional procedures. An effective amount will generally be in the range of about 0.1 to 2.0 pounds per ton of ore but variations outside this range may arise depending upon the specific phosphate mineral being processed, the nature and amount of gaugue material present, the particular combination collector employed, the recovery and grade values desired, and the like. Phosphate minerals are generally froth floated at a pH in the range of 6.0 to 12.0, preferably about 8.0 to 10.0. It may be necessary to employ a pH regulator to achieve the desired pH value. Generally, an alkali is added, such as caustic, ammonia or other alkaline material. In the case of phosphate rock, fuel oil is generally added to control excessive frothing but this additive is not necessary for other minerals.

In carrying out the present process, two collector components are used in admixture in froth flotation to provide superior performance over that obtained with either component alone at equal total collector use level.

The first component of the collector combination is a fatty acid derived from a vegetable or animal oil. Vegetable oils include babassu, caster, chinese tallow, coconut, corn cottonseed, grapeseed, hempseed, kapok, linseed, wild mustard, oiticica, olive, ouri-ouri, palm, palm kernel, peanut, perilla, poppyseed, argentine rapeseed, rubberseed, safflower, sesame, soybean, sugarcane, sunflower, fall, teaseed, tung, and uchukuba oils. Animal oils include those derived from fish and livestock. These oils contain acids having carbon atoms ranging in number from about six to twenty-eight or more and may be saturated or unsaturated, hydroxylated or not, linear or cyclic, and the like.

The second component of the collector combination is a dialkyl sulfosuccinic acid of the general structure.

$$\begin{array}{c} CH_2COOR \\ | \\ XO_3S-CHCOOR' \end{array}$$

wherein R and R' are individually alkyl radicals of about 4 to 18 carbon atoms and X is hydrogen or alkali metal or ammonium ion. Typical compounds of this structure include sodium di(methylamyl)sulfosuccinate, sodium di(2-ethylhexyl)sulfosuccinate, sodium di(n-octyl)sulfosuccinate, sodium di(tridecyl)sulfosuccinate, sodium di(octadecyl)sulfosuccinate, and the corresponding free acids, ammonium salts and potassium salts.

The collector combination will comprise from about 1 to 99 weight percent and correspondingly from about 1 to 99 weight percent of dialkyl sulfosuccinate acid or salt thereof. Preferably, from about 3 to 10 weight percent of dialkyl sulfosuccinic acid or salt thereof are employed in combination with, correspondingly from about 97 to 90 weight percent of fatty acid. The collector combination may be added in admixture or as separate ingredients. In preparing admixtures it is generally preferrable to add the required alkali to the fatty acid and then mix in a dialkyl sulfosuccinate salt.

After the ore slurry has been conditioned as indicated, it is subject to froth flotation following conventional procedures. The desired mineral values will be recovered with the froth and the gaugue will remain behind.

The invention is more fully illustrated in the examples which follow wherein all parts and percentages are by weight. The following general procedure is employed in the froth flotation examples which follow.

GENERAL PROCEDURE

Rougher Float

Step 1: Secure washed and sized feed, e.g., 35×150 mesh screen fractions. Typical feed is usually a mixture of 23% coarse with 77% fine flotation particles.

Step 2: Sufficient wet sample, usually 640 grams, to give a dry weight equivalent of 500 grams. The sample is washed once with about an equal amount of tap water. The water is carefully decanted to avoid loss of solids.

Step 3: The moist sample is conditioned for one minute with approximately 100 cc of water, sufficient caustic as 5–10% aqueous solution to obtain the pH desired (pH 9.5–9.6) a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct end point. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4: Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5: The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are the dry weights of the concentrate and tailings, respectively, and $P_c$ and $P_t$ are the weight percent $P_2O_5$ or BPL of the concentrate or tails, respectively.

COMPARATIVE EXAMPLE A

Following the procedure, a run was made using Florida pebble phosphate. In this run, a fatty acid derived from tall oil was used with No. 5 fuel oil following conventional froth flotation procedures at pH 9.0. Dosage of fatty acid was 0.44 lbs. per ton of ore and dosage of No. 5 fuel oil was also 0.44 lbs. per ton of ore. Results of the flotation were as follows:

| | |
|---|---|
| Weight Recovery (%) | = 13.65 |
| Feed, % BPL | = 18.64 |
| Tail, % BPL | = 10.93 |
| Concentrate, % BPL | = 67.45 |
| % BPL Recovery | = 49.38 |

EXAMPLE 1

The general procedure was again followed using Florida pebble phosphate. In this run, the same fatty acid as used in Comparative Example A was employed with No. 5 fuel oil. In addition, sodium dibutylsulfosuccinate was used to replace a small proportion of the fatty acid dosage of Comparative Example A. The mixture used was 0.405 lbs./ton of fatty acid and 0.035 lbs./ton of sodium dibutylsulfosuccinate in conjunction with 0.44 lbs./ton of No. 5 fuel oil and froth flotation was at pH 9.0. Results of the flotation were as follows:

| | |
|---|---|
| Weight Recovery (%) | = 15.29 |
| Feed, % BPL | = 20.60 |
| Tail, % BPL | = 11.77 |
| Concentrate, % BPL | = 69.54 |
| % BPL Recovery | = 51.61 |

These results show that the combination of sulfosuccinate and fatty acid resulted in 4.5% better BPL recovery and 3.1% better grade than obtained with fatty acid alone. (Compare results of Example 1 and Comparative Example A).

EXAMPLE 2

The procedure of Example 1 was followed in every material detail except that in place of the dosage of sodium dibutylsulfosuccinate employed therein there was substituted an equal amount of sodium diamylsulfosuccinate. Results of the flotation were as follows:

| | |
|---|---|
| Weight Recovery (%) | = 18.76 |
| Feed, % BPL | = 18.38 |
| Tail, % BPL | = 6.17 |
| Concentrate % BPL | = 71.03 |
| % BPL Recovery | = 72.67 |

These results show that the combination of sulfosuccinate and fatty acid resulted in 47.2% better BPL recovery and 5.3% better grade than obtained with fatty acid alone. (Compare results of Example 2 and Comparative Example A).

EXAMPLE 3

The procedure of Example 1 was again followed in every material detail except that in place of the dosage of sodium dibutyl sulfosuccinate employed therein there was substituted an equal amount of sodium dihexylsulfosuccinate. Results of the flotation were as follows:

| | |
|---|---|
| Weight Recovery (%) | = 19.95 |
| Feed, % BPL | = 19.41 |
| Tail, % BPL | = 7.01 |

-continued

| | |
|---|---|
| Concentrate % BPL | = 69.18 |
| % BPL Recovery | = 71.09 |

These results show that the combination of sulfosuccinate and fatty acid resulted in 44.0% better BPL recovery at 2.6% better grade than obtained with fatty acid alone. (Compare results in Example 3 and Comparative Example A).

EXAMPLE 4

The procedure of Example 1 was again followed in every material detail except that in place of the dosage of sodium dibutyl sulfosuccinate employed therein there was substituted an amount of sodium di(tridecyl)-sulfosuccinate. Results of the flotation were as follows:

| | |
|---|---|
| Weight Recovery (%) | = 17.07 |
| Feed, % BPL | = 18.02 |
| Tail, % BPL | = 7.96 |
| Concentrate % BPL | = 66.91 |
| % BPL Recovery | = 63.37 |

These results show that the combination of sulfosuccinate and fatty acid resulted in 28.3% better BPL recovery at a loss of only 0.8% in grade compared to the use of fatty acid alone. (Compare results of Example 4 and Comparative Example A).

COMPARATIVE EXAMPLES B–F

The procedure of Comparative Example A was repeated in every material detail except that varying amounts of fatty acid and No. 5 fuel oil were employed in a series of runs. The results and test details are given in Table I which follows:

TABLE I

| | | | Dosage Performance | | | | |
|---|---|---|---|---|---|---|---|
| | Acid | Fuel Oil | Weight | % BPL | | | BPL |
| Example | (lbs./ton) | (lbs./ton) | Recovery (%) | Feed | Tail | Concentrate | Recovery (%) |
| B | 0.34 | 0.34 | 8.94 | 19.86 | 15.14 | 67.98 | 30.60 |
| C | 0.37 | 0.37 | 11.05 | 18.23 | 11.83 | 69.77 | 42.29 |
| D | 0.40 | 0.40 | 12.77 | 18.15 | 10.65 | 69.36 | 48.81 |
| A | 0.44 | 0.44 | 13.65 | 18.64 | 10.93 | 67.45 | 49.38 |
| E | 0.47 | 0.47 | 15.19 | 18.95 | 10.71 | 64.94 | 52.06 |
| F | 0.50 | 0.50 | 15.10 | 17.73 | 8.47 | 69.77 | 59.43 |

EXAMPLES 5–9

The procedure of Example 1 was again followed in every material detail except that sodium di(2-ethylhexyl) sulfosuccinate was employed in place of sodium dibutyl sulfosuccinate and the dosage amounts of sulfosuccinate and fuel oil were varied in separate runs. The results and test details are given in Table II which follows.

TABLE II

| | | | Composition And Dosage Performance | | | | | |
|---|---|---|---|---|---|---|---|---|
| | Acid | Sodium Dioctyl Sulfosuccinate | Fuel Oil | Weight | % BPL | | | BPL |
| Example | (lbs./ton) | (lbs./ton) | (lbs/ton) | Recovery (%) | Feed | Tail | Conc. | Recovery (%) |
| 5 | .252 | .088 | 0.34 | 18.97 | 19.28 | 7.29 | 70.44 | 69.36 |
| 6 | .30 | .07 | 0.37 | 19.16 | 19.32 | 7.23 | 70.31 | 69.74 |
| 7 | .348 | .052 | 0.40 | 19.74 | 18.79 | 6.22 | 69.89 | 73.43 |
| 8 | .405 | .035 | 0.44 | 18.98 | 18.25 | 5.49 | 72.72 | 75.63 |
| 9 | .451 | .019 | 0.50 | 19.46 | 18.58 | 5.89 | 71.09 | 74.47 |

These results again show the unexpected improvements in BPL recovery without significant loss in grade that are obtained when a portion of the fatty acid collector conventionally employed is replaced by a dialkyl sulfosuccinate salt. It is particularly significant to compare the results of Example 5 with those of Comparative Example F. This comparison shows that at 32% less dosage, the combination of fatty acid and sulfosuccinate provides 27.4% better BPL recovery at about 1% better grade. This amounts to a 50.4% savings in fatty acid while still providing increased mineral recovery.

EXAMPLE 10

The procedure of Example 1 was again followed using a crude tall oil fatty acid alone or in combination with sodium di-(2-ethylhexyl)sulfosuccinate. Details and results are given in Table III.

TABLE III

| Acid (lbs/ton) | Sodium Dioctyl Sulfosuccinate (lbs/ton) | Recycled Motor Oil (lbs/ton) | Weight Recovery (%) | % BPL Feed | % BPL Tail | % BPL Conc. | BPL Recovery (%) |
|---|---|---|---|---|---|---|---|
| | Composition And Dosage Performance | | | | | | |
| 0.3 | — | 0.6 | 0.8 | 14.31 | 14.30 | 22.32 | 0.12 |
| 0.4 | — | 0.8 | 4.41 | 14.66 | 12.70 | 57.19 | 17.20 |
| 0.5 | — | 1.0 | 18.89 | 15.28 | 7.18 | 50.07 | 61.89 |
| 0.38 | 0.02 | 0.8 | 15.74 | 14.91 | 6.21 | 61.51 | 64.92 |
| 0.36 | 0.04 | 0.8 | 20.94 | 15.72 | 3.81 | 60.67 | 80.83 |
| 0.32 | 0.08 | 0.8 | 24.29 | 15.29 | 2.21 | 56.07 | 89.06 |
| 0.28 | 0.12 | 0.8 | 24.88 | 15.04 | 3.26 | 50.60 | 83.72 |
| 0.24 | 0.16 | 0.8 | 25.92 | 14.64 | 2.26 | 50.01 | 88.56 |
| 0.20 | 0.20 | 0.8 | 26.00 | 14.64 | 2.21 | 50.01 | 88.83 |
| 0.16 | 0.24 | 0.8 | 25.49 | 14.66 | 3.81 | 46.36 | 80.63 |
| 0.12 | 0.28 | 0.8 | 28.48 | 14.12 | 3.92 | 39.75 | 80.14 |
| 0.08 | 0.32 | 0.8 | 26.36 | 14.60 | 4.47 | 42.89 | 77.45 |
| 0.04 | 0.36 | 0.8 | 23.49 | 15.00 | 5.25 | 46.77 | 73.23 |
| — | 0.40 | 0.8 | 6.46 | 14.47 | 11.65 | 55.25 | 24.67 |

We claim:

1. A process for beneficiating phosphate ores which comprises sizing the ore to provide mineral values of flotation size, slurrying the sized ore in aqueous medium, conditioning the slurried ore with an effective amount of a combination collector adding fuel oil to control excessive frothing, and thereafter recovering the desired mineral values by froth flotation, said collector combination comprising from about 1 to about 99 weight percent of a fatty acid derived from a vegetable or animal oil and, correspondingly, from about 99 to about 1 weight percent of a dialkyl sulfosuccinic acid or the salt thereof of the general structure $$\begin{array}{l} \quad\;\; CH_2COOR \\ \quad\;\; | \\ XO_3S-CHCOOR' \end{array}$$

wherein R and R' are individually alkyl radicals of about 4 to 18 carbon atoms and X is hydrogen or alkali metal or ammonium ion.

2. The process of claim 1 wherein said dialkylsulfosuccinic acid has the structure:

$$\begin{array}{l} \quad\;\; CH_2COOC_4H_9 \\ \quad\;\; | \\ NaO_3S-CHCOOC_4H_9 \end{array}.$$

3. The process of claim 1 wherein said dialkylsulfosuccinic acid has the structure:

$$\begin{array}{l} \quad\;\; CH_2COOC_5H_{11} \\ \quad\;\; | \\ NaO_3S-CHCOOC_5H_{11} \end{array}.$$

4. The process of claim 1 wherein said dialkylsulfosuccinic acid has the structure:

$$\begin{array}{l} \quad\;\; CH_2COOC_6H_{13} \\ \quad\;\; | \\ NaO_3S-CHCOOC_6H_{13} \end{array}.$$

5. The process of claim 1 wherein said dialkylsulfosuccinic acid has the structure:

$$\begin{array}{l} \quad\;\; CH_2COOC_{13}H_{27} \\ \quad\;\; | \\ NaO_3S-CHCOOC_{13}H_{27} \end{array}.$$

6. The process of claim 1 wherein said dialkylsulfosuccinic acid has the structure:

$$\begin{array}{l} \quad\;\; CH_2COOC_8H_{17} \\ \quad\;\; | \\ NaO_3S-CHCOOC_8H_{17} \end{array}.$$

7. The process of claim 1 wherein said fatty acid is derived from tall oil.

8. The process of claim 1 wherein said fatty acid is derived from tall oil and said dialkylsulfosuccinic acid has the structure:

$$\begin{array}{l} \quad\;\; CH_2COOC_8H_{17} \\ \quad\;\; | \\ NaO_3S-CHCOOC_8H_{17} \end{array}.$$

9. The process of claim 1 wherein said collector combination comprises from 74 to 96 weight percent of a fatty acid derived from tall oil and from 26 to 4 weight percent of a dialkylsulfosuccinic acid of the structure:

$$\begin{array}{l} \quad\;\; CH_2COOC_8H_{17} \\ \quad\;\; | \\ NaO_3S-CHCOOC_8H_{17} \end{array}.$$

10. The process of claim 1 wherein said collector combination comprises 74 weight percent of a fatty acid derived from tall oil and 26 weight percent of a dialkylsulfosuccinic acid of the structure:

$$\begin{array}{l} \quad\;\; CH_2COOC_8H_{17} \\ \quad\;\; | \\ NaO_3S-CHCOOC_8H_{17} \end{array}.$$

* * * * *